US007430389B2

(12) United States Patent
Noguchi et al.

(10) Patent No.: US 7,430,389 B2
(45) Date of Patent: Sep. 30, 2008

(54) IMAGE FORMING APPARATUS WITH TRANSPARENT TONER DEVELOPER

(75) Inventors: Akihiro Noguchi, Toride (JP); Tadayoshi Nishihama, Abiko (JP); Kota Arimoto, Abiko (JP); Tadashi Fukuda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/468,510

(22) Filed: Aug. 30, 2006

(65) Prior Publication Data

US 2007/0053726 A1 Mar. 8, 2007

(30) Foreign Application Priority Data

Sep. 8, 2005 (JP) ..... 2005-261413

(51) Int. Cl.
*G03G 15/01* (2006.01)

(52) U.S. Cl. ..... 399/223; 399/298; 399/299

(58) Field of Classification Search ..... 399/298, 399/299, 223

See application file for complete search history.

(56) References Cited

U.S. PATENT DOCUMENTS 5,701,568 A * 12/1997 Hiroshima et al. ..... 399/302
2006/0140651 A1 6/2006 Hirobe et al. ..... 399/27
2006/0198661 A1 9/2006 Nishihama et al. ..... 399/257
2007/0048021 A1 3/2007 Fumitake et al. ..... 399/223

FOREIGN PATENT DOCUMENTS

JP 2000-147863 5/2000
JP 2002-49204 2/2002

OTHER PUBLICATIONS

Machine translation of JP 2002-049204, supplied in Applicant's 1449.*

* cited by examiner

*Primary Examiner*—David M Gray
*Assistant Examiner*—Bryan Ready
(74) *Attorney, Agent, or Firm*—Fitzpatrick, Cella, Harper & Scinto

(57) ABSTRACT

An image forming apparatus includes a first image bearing member; a first developing means forming a toner image of transparent toner on an electrostatic latent image formed on the first image bearing member; a second image bearing member having an electrostatic capacity per unit area which is smaller than an electrostatic capacity per unit area of the first image bearing member; second developing means for forming a toner image of chromatic toner on an electrostatic latent image formed on the second image bearing member, wherein a maximum toner amount of the toner image formed on the first image bearing member is larger than a maximum toner amount of the toner image formed on the second image bearing member; and transferring means for transferring the transparent toner image and the chromatic toner image onto a transfer material.

16 Claims, 8 Drawing Sheets

IMAGE FORMING APPARATUS WITH TRANSPARENT TONER DEVELOPER

FIELD OF THE INVENTION AND RELATED ART

The present invention relates to an image forming apparatus for forming an image using an electrophotographic type process.

Conventionally, image forming apparatuses which form images on recording materials using an electrophotographic type process are known. More particularly, such apparatuses include an image forming apparatus such as a copying machine, a printer (laser beam printer, LED printer or the like), a facsimile machine, or a complex machine having a plurality of functions of them.

In an electrophotographic type image forming apparatus, an image (latent image) is formed on an image bearing member in the form of a cylindrical electrophotographic photosensitive member (photosensitive member), and the electrostatic image is developed with a developer (toner) into a toner image. The toner image is transferred onto a recording material such as paper or the like by an electrostatic force. Thereafter, the toner image on the recording material is welded and fused by heat and pressure by a fixing device so that toner image is fixed on the recording material.

As a color image forming apparatus in which a plurality of kinds of toner are overlaid to form an image on a recording material, there are various types. In one type, each time a toner image is formed on the photosensitive member, the toner image is transferred at a transfer portion onto the recording material carried on a recording material carrying member, and it is repeated sequentially, so that plurality of kinds of toner images are overlaid on the recording material (direct transfer type). Another type is called intermediary transfer type. In this type, each time the toner image formed on the photosensitive member, the toner image is transferred onto an intermediary transfer member at a primary transfer portion, so that such toner images are overlaid on the intermediary transfer member. Then, the toner images are transferred superimposedly onto a recording material altogether (secondary transfer).

In the color image forming apparatus, a light image exposure step is repeated with color-separated images using red, green and blue filters on the electrically charged photosensitive member, so that electrostatic images corresponding to the image information of separated colors are formed on the photosensitive member. The toner images of the electrostatic images are finally transferred onto the recording material. The toner images of the plurality of colors are thereafter fused and fixed by heat on the recording material. By doing so, a color image is formed on the recording material.

In the portion having a high color density of the toner image, a plurality of color toners are overlaid, and therefore, the toner layer is relatively thicker. On the other hand, the overlaid toner layer is relatively thinner in the portion of the toner image having a low color density, and particularly, there is no toner layer in the white background portion.

As a result, the heights of the topmost layers of the image are different depending on the difference in the color density. Because of this, the high color density portion exhibits a high glossiness, but the low color density portion, particularly, the white background portion exhibits hardly any glossiness. As a result, the glossiness of the image region is non-uniformity.

Recently, the use of transparent toner and/or white toner is proposed for the purpose of improvement in the uniformity of the glossiness.

Japanese Laid-open Patent Application 2000-147863 discloses an image forming apparatus using color toner (chromatic toner) and transparent toner. Japanese Laid-open Patent Application 2000-147863 discloses that transparent toner is transferred to the area having a small amount of toner in consideration of the thickness of the toner layer forming the color toner image. With such a structure of the image forming apparatus, the surface of the color image portion becomes uniform so that glossiness of the image becomes uniform.

On the other hand, Japanese Laid-open Patent Application 2002-49204 discloses the use of the white toner in order to accomplish fine tone gradation printing. Japanese Laid-open Patent Application 2002-49204 relates to an electrophotographic type image forming method which forms a halftone image using a white toner, wherein the white toner is dispersed at the time of the image transfer by which a fine tone gradation printing is accomplished. And, in the electrostatic latent image forming process thereof, two kinds of electrostatic latent image bearing member are formed for the purpose of white toner image formation and chromatic toner image formation. This document discloses that in order to promote toner scattering during the transfer operation of the white toner, the thickness of the photosensitive layer of the photosensitive member for the white toner image formation is made thinner than those of the other photosensitive member for the chromatic toner image formation.

From the standpoint of improving the uniformity in the glossiness of the image as a whole by uniformizing the surface of the toner layer, the structure of the Japanese Laid-open Patent Application 2000-147863 is preferable to the structure of the Japanese Laid-open Patent Application 2002-49204.

In the field of an image forming apparatus which forms a chromatic image, a two component developing system is widely used in which the developer is a mixture mainly of non-magnetic toner (toner) and magnetic carrier (carrier). The two component developing system is advantageous in the stability of the image quality and in the durability of the apparatus.

However, it has been found that when the transparent toner is used in an attempt to accomplish the object disclosed in the Japanese Laid-open Patent Application 2000-147863, in the image forming apparatus using the two component developing system, the deterioration of the image quality attributable to the deposition of the carrier to the image portion and/or toner contamination in the image forming apparatus due to the toner scattering tends to arise.

The maximum value of the amount of deposition (adherence amount) per unit area of the toner of the four-color image on the recording material is ordinarily approx. 1.5 g/cm$^2$ from the viewpoint of preventing the fixing offset or the like. In such a case, in order to uniformize the glossiness of the entirety of the image using the transparent toner, it is required that amount of at least 1.5 g/cm$^2$ approx. Of transparent toner is supplied to the photosensitive member.

In order to supply the amount of 1.5 g/cm$^2$ of transparent toner by one developing process, the following methods will be considered.

(1) the charge amount (toner triboelectric charge) per unit weight of the toner is made approximately ⅓ of that of the chromatic toner.

(2) the difference in the potential (contrast potential) between the image portion potential of the photosensitive member and the averaging potential of the bias voltage applied to the developer carrying member of the developing device is made 3 times the contrast potential of the chromatic toner.

If the amount of toner triboelectric charge of the transparent toner is as in case (1) ⅓ of that of the chromatic toner, a centrifugal force of the toner particles on the rotating developer carrying member may exceeds the electrostatic depositing force between the toner particle and the carrier particle. This may lead to a great amount of the transparent toner scattering, and therefore, to contamination of the inside of the image forming apparatus.

If the contrast potential is approx. 3 times the contrast potential at the time of the developing process for the chromatic toner, a large amount of the electric charge is injected into the photosensitive member from the carrier. Then, the mirror force between the carrier and the photosensitive member is so strong that carrier particles tend more to deposit on the photosensitive member. If the carrier deposited on the photosensitive member is transferred onto the recording material, black points appear in the white background portion, and therefore, the image quality remarkably deteriorates.

Thus, the adjustment of the toner adherence using the contrast potential is not preferable since then the image quality may deteriorates.

SUMMARY OF THE INVENTION

The primary object of the present invention is to provide an image forming apparatus capable of increasing the maximum amount by which transparent toner is adhered to transfer medium, without extremely increasing the contrast potential.

According to an aspect of the present invention, there is provided an image forming apparatus comprising a first image bearing member; a first developing means forming a toner image of transparent toner on an electrostatic latent image formed on said first image bearing member; a second image bearing member having an electrostatic capacity per unit area which is smaller than an electrostatic capacity per unit area of said first image bearing member; second developing means for forming a toner image of chromatic toner on an electrostatic latent image formed on said second image bearing member, wherein a maximum toner amount of the toner image formed on said first image bearing member is larger than a maximum toner amount of the toner image formed on said second image bearing member; and transferring means for transferring the transparent toner image and the chromatic toner image onto a transfer material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described in detail with reference to the preferred embodiments.

Hereinafter, the preferred image forming apparatus in accordance with the present invention will be described in more detail with reference to the appended drawings. Incidentally, the measurements, materials, and shapes of the structural components of the image forming apparatus, and the positional relationship among the structural components, are not intended to limit in scope the present invention to the preferred embodiments of the present invention, unless specifically noted.

Embodiment 1

Figure 1:
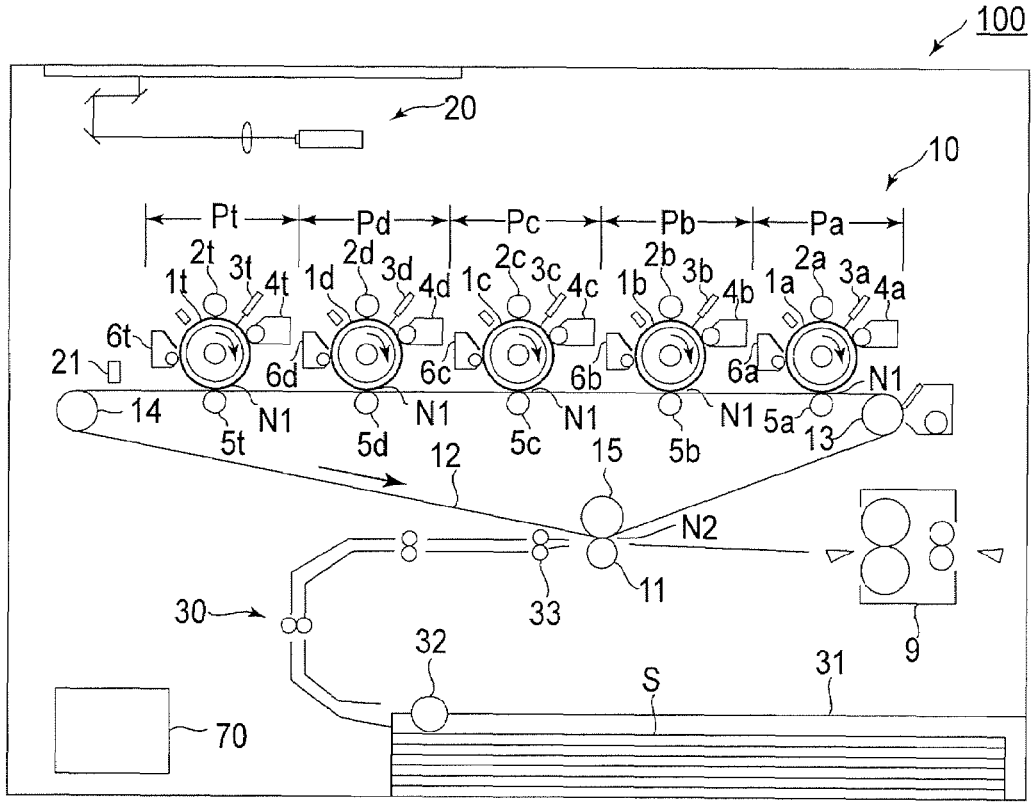
FIG. 1 is a schematic sectional view of the image forming apparatus in the first preferred embodiment of the present invention, showing the structure thereof.

First, referring to FIG. 1, the overall structure and operation of the image forming apparatus in this embodiment will be described. FIG. 1 is a schematic sectional view of the image forming apparatus 100 in this embodiment, showing the general structure thereof. The image forming apparatus 100 in this embodiment is a multifunction image forming apparatus having copying, printing, and facsimile functions. The main assembly of the image forming apparatus 100 has a printer portion 10 which forms an image on recording medium, and an image reading apparatus 20. The image forming apparatus employs an electrophotographic image forming method, and forms a full-color image, based on the information obtained from an original image, or in response to the image information signals (video signals) sent from an external device, such as a personal computer or a digital camera, which is connected to the apparatus main assembly so that information can be transmitted between the external device and apparatus main assembly.

The printer portion 10 has multiple image formation stations as image forming means. More specifically, the printer portion 10 has five image formation stations: first, second, third, and fourth image formation stations Pa, Pb, Pc, and Pd for forming yellow, magenta, cyan, and black toner images, respectively, and a fifth image formation station Pt which forms a transparent toner image, that is, an image formed of transparent toner.

Thus, the printer portion 10 is provided with five cylindrical photosensitive members as image bearing members: photosensitive drums 1*a*, 1*b*, 1*c*, 1*d*, and 1*t*. The printer portion 10 is also provided with developing devices 4*a*, 4*b*, 4*c*, 4*d*, and 4*t*, which correspond to the photosensitive drums 1*a*, 1*b*, 1*c*, 1*d*, and 1*t*, and which are filled with five developers different in spectral characteristics, one for one. These five image formation stations Pa, Pb, Pc, Pd, and Pt, each of which a combination of one photosensitive drum and one developing device, are aligned in parallel, in the direction parallel to the direction in which the portion of the surface of an intermediary transfer belt 12, which faces the image formation stations, moves.

Incidentally, in this embodiment, all the image formation stations are practically the same in basic structure and operation; they are different only in the type of toner they use, and the image bearing members which will be described later in detail. Therefore, when it is unnecessary to individually describe all the image formation stations, the referential suffixes a, b, c, d, and t, which are added to the primary referential symbols to indicate the relationship between each component and the corresponding color component, may be eliminated to describe the features common among all the image formation stations.

In the image formation station P, the photosensitive drum 1 is rotatably supported so that it is rotatable in the direction indicated by an arrow mark in the drawing. The adjacencies of the peripheral surface of the photosensitive drum 1 are structured as follows. That is, in the adjacencies of the peripheral surface of the photosensitive drum 1, a charging device 2 (charge roller), which is the charging means for charging the photosensitive drum 1, a laser scanner 3 (optical exposing system) which is the exposing means for exposing the charged area of the peripheral surface of the photosensitive drum 1, in accordance with the image information, and a developing apparatus 4 which is the developing means for supplying the photosensitive drum 1 with toner to form a toner image, are disposed. Also disposed in the adjacencies of the peripheral surface of the photosensitive drum 1 are the intermediary transfer belt 12, a primary transfer roller 5 which is a primary transferring means, and a cleaner 6 which is a cleaning means for recovering the toner remaining on the peripheral surface of the photosensitive drum 1. The primary transfer roller 5 is disposed in a manner to oppose the photosensitive drum 1, with the intermediary transfer belt 12 interposed between the transfer roller 5 and photosensitive drum 1.

The intermediary transfer belt 12 is stretched around multiple rollers, which in this embodiment are three rollers: a driver roller 13, a follower roller 14, and a secondary transfer counter roller 15. As driving force is transmitted to the driver roller 13, the intermediary transfer belt 12 circularly moves in the direction indicated by an arrow mark in the drawing. On the inward side of the loop which the intermediary transfer belt 12 forms, the primary transfer roller 5 which is a primary transferring means is disposed in a manner to oppose the photosensitive drum 1, with the intermediary transfer belt 12 pinched between the primary transfer roller 5 and photosensitive drum 1. Thus, the intermediary transfer belt 12 is placed in contact with the peripheral surface of the photosensitive drum 1, forming a primary transfer station N1 (primary transfer nip). There is a secondary transfer roller 11, as a secondary transferring means, which is disposed in a manner to be pressed against the secondary transfer counter roller 15, with the intermediary transfer belt 12 pinched between the secondary transfer roller 11 and the secondary transfer counter roller 15, forming a secondary transfer station N2 (secondary transfer nip).

For example, when forming a full-color image, the photosensitive drums 1*a*, 1*b*, 1*c*, 1*d*, and 1*t* in the image formation stations Pa, Pb, Pc, Pd, and Pt for forming yellow, magenta, cyan, black, and transparent images, respectively, rotate in the direction indicated by the arrow marks in the drawing. As the photosensitive drum 1 rotates, the peripheral surface of the photosensitive drum 1 is uniformly charged by the charging device 2. Next, optical images, which correspond, one for one, to the primary color components into which the optical image of the original image were separated, are projected onto the peripheral surfaces of the photosensitive drums 1*a*-1*t*, in accordance with the image information read by the image reading apparatus 20, for example. As a result, an electrostatic image is formed on the peripheral surface of each photosensitive drum 1.

In this embodiment, the electrostatic image formed on the photosensitive drum 1 is reversely developed by the developing device 4. That is, toner particles charged to the same polarity as the polarity of the charged peripheral surface of the photosensitive drum 1 adhere to the numerous points of the charged peripheral surface of the photosensitive drum, which have been attenuated in potential by the exposure, effecting a toner image, that is, an image formed of toner, on the peripheral surface of the photosensitive drum 1. In this process, development bias is applied to the developer bearing member with which the developing device 4 is provided, from a development bias power source (unshown) which is a developer bias outputting means.

The toner image formed on the peripheral surface of the photosensitive drum 1 is transferred (primary transfer) onto the intermediary transfer member in the form of a belt, that is, the intermediary transfer belt 12, which is the object onto which the toner image is to be transferred. In this process, a primary transfer bias, the polarity of which is opposite to the normal polarity (negative in this embodiment) of the toner potential, is applied to the primary transfer roller 5 from a primary transfer bias power source (unshown) which is a primary transfer bias outputting means.

When forming a full-color image, the above described operations are carried out in the first, second, third, fourth, and fifth image formation stations Pa, Pb, Pc, Pd, and Pt, and the toner images formed in the image formation stations Pa-Pd are sequentially transferred (primary transfer) in layers onto the intermediary transfer belt 12. As a result, a single full-color toner image is formed on the intermediary transfer belt 12.

In this embodiment, in order to improve the level of glossiness at which an image is formed, and the level of the surface smoothness at which an image is formed, that is, in order to yield a full-color image (made up of multiple layers of toner) which is roughly level across its surface, a layer of transparent toner (image formed of transparent toner) is provided on the full-color image made up of the four primary color toners. More specifically, to the portions of the image formation area, to which a relatively larger amount of color toners is adhered, a relatively smaller amount of transparent toner is adhered, whereas, to the portions of the image formation area, to which a relative smaller amount of color toners is adhered, a relatively larger amount of transparent toner is adhered. This process will be described later in more detail.

Incidentally, a toner image, which is roughly level across its surface, may be formed by adhering transparent toner to the entirety of the image formation area, and then, adhering color toners and transparent toner to the surface of this layer of transparent toner in manner to form a virtually flat image. Further, an additional layer of transparent toner may be placed on the surface of a virtually flat and smooth image formed of color toners and transparent toner.

Thereafter, the full-color toner image on the intermediary transfer belt 12 are transferred all at once (secondary transfer) onto a recording medium S, in the secondary transfer station N2. In this process, a secondary transfer bias, the polarity of which is opposite to the normal polarity of the toner potential, is applied to the secondary transfer roller 11 from a secondary transfer bias power source (unshown) which is a secondary transfer bias outputting means.

The recording medium S is conveyed to the secondary transfer station N2 from a recording medium supplying station 30. More specifically, multiple recording mediums S are stored in a recording medium storage cassette 31 in the recording medium supplying station 30. The recording mediums S are sent out one by one from the recording medium storage cassette 31 by a pickup roller 32 or the like, which is a recording medium supplying means. Then, each recording medium S is conveyed to the secondary transfer station N2 by a pair of registration rollers 33, with a preset timing.

After the toner images are transferred onto the recording medium S in the secondary transfer station N2, the recording medium S is conveyed to a fixing device 9 of the thermal roller type, which is a fixing means, through a conveyance path. The toner images are fixed to the recording medium S by the fixing device 9. Thereafter, the recording medium S is discharged into a delivery tray or a post-processing apparatus (unshown).

The image forming apparatus 100 is provided with an optical sensor 21, which is a detecting means for detecting the toner on the intermediary transfer belt 12. The optical sensor is located as follows. In terms of its relation to the aforementioned belt loop, the optical sensor 21 is disposed on the outward side of the belt loop, facing directly the area of the outward surface (in terms of belt loop) of the intermediary transfer belt 12, which is serving as the toner image transferring area of the intermediary transfer belt 12. In terms of the moving direction of the intermediary transfer belt 12, the optical sensor 21 is disposed between the primary transfer station N1 of the image formation station Pt, which is the most downstream image formation station, and the follower roller 14 located further downstream of the image formation station Pt. The optical sensor 21 detects the deviations and densities of the images transferred from the photosensitive drums 1*a*, 1*b*, 1*c*, 1*d*, and 1*t* of the image formation stations Pa, Pb, Pc, Pd, and Pt. The outputs of the optical sensor 21 are inputted into a controller 70, which controls (adjusts), as necessary, the image formation stations Pa, Pb, Pc, Pd, and Pt, in the image density, amount of toner replenishment, image writing timing, image writing starting point, etc., based on the outputs of the optical sensor 21.

[Photosensitive Member]

Figure 3:
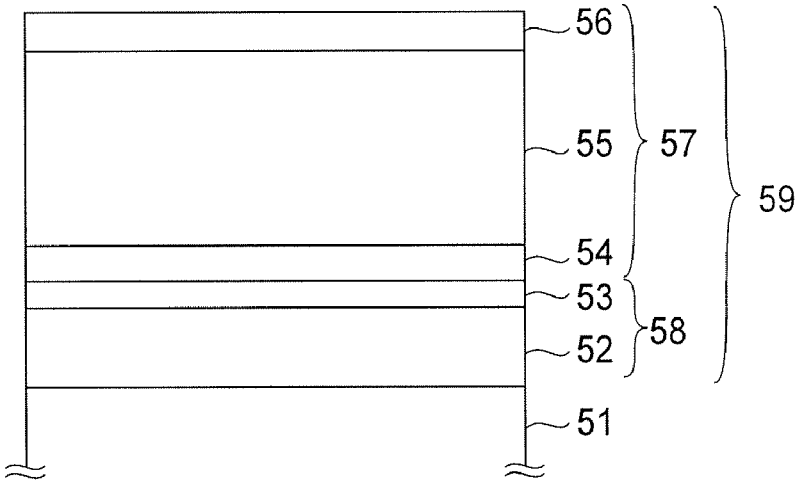
FIG. 3 is a schematic drawing showing an example of the laminar structure of a photosensitive drum.

Next, the photosensitive drum 1 will be further described. Referring to FIG. 3, the photosensitive drum 1, which is rotationally driven, generally has a cylindrical substrate 51 (for supporting photosensitive layer) formed of an electrically conductive material. The photosensitive drum 1 also has a photosensitive layer 57 formed on the peripheral surface of the electrically conductive substrate 51. The photosensitive layer 57 is made up of multiple sublayers coated in layers on the peripheral surface of the substrate 51: a charge generation layer 54 in which charged particles are generated, a charge transfer layer 55 capable of transferring the charged particles generated in the charge generation layer 54, and a surface protection layer 56, which is the outermost layer. The photosensitive layer 57 may be made up of only the charge generation layer 54 and charge transfer layer 55, although the addition of the surface protection layer 56 can improve the properties of the photosensitive drum 1. Further, some photosensitive layer 57 has only a single layer.

Further, the photosensitive drum 1 may be provided with an intermediary layer 58, which is placed between the electrically conductive substrate 51 and charge generation layer 54. The provision of the intermediary layer 58 can improve the photosensitive drum 1 in terms of the adhesion between the electrically conductive substrate 51 and photosensitive layer 57, the manner in which the photosensitive layer 57 can be coated, and the protection of the electrically conductive substrate 51. The provision of the intermediary layer 58 can also improve the photosensitive drum 1 in terms of the covering of the surface defects of the electrically conductive substrate 51, protection of the photosensitive layer 57 from electrical damages, manner in which electric charge is injected from the electrically conductive substrate 51 into the photosensitive layer 57, etc.

The electrically conductive substrate 51 may be formed of a metallic material, such as aluminum and copper, or cardboard, plastic, etc., processed for electrical conductivity.

The photosensitive layer 57 is formed by vacuum-evaporating a chalcogenide compound such as selenium, arsenic selenide, or selenium-tellurium-arsenic alloy, silicon, germanium, phthalocyanine pigment, cadmium sulfide or the like. Alternatively, it may be formed by silicon, germanium or the like through a CVD process. Further alternatively, it may be formed by applying color-sensitized zinc oxide, selenium powder, amorphous silicon powder, polyvinylcarbazole, phthalocyanine pigment, oxadiazole pigment or the like with binding resin material as desired.

When the photosensitive layer 57 is to made up by forming in layers the charge generation layer 54 and charge transfer layer 55, and an organic photoconductor is to be used as the material for the photoconductive layer, the charge generating material is dispersed in the binder resin for the material for the charge generation layer 5. The charge generating material may be an azo pigment such as Sudan red, dian blue or the like; a disazo pigment, a quinone pigment such as algol-yellow, pyrene-quinone or the like; or quinocyanine pigment, for example. The charge generating material may be a perilenic pigment; an indigo pigment such as indigo indigo or thioindigo; a bisbenzimidazole pigment such as indo fast orange or the like; quinacridone pigment; pyrylium salt; azulenium salt; or the like. The binder resin material may be polyester, polyvinyl acetate, acrylic, polybarbonate, polyallylate, polystyrene polyvinyl butyral or the like resin material. The binder resin material may be polyvinylpyrolidone, methyl cellulose, nydroxyproplyl methylcellulose, cellulose ester, for example. It may be formed by evaporation or the like. The thickness of the charge generation layer 54 is desired to be in a range of 0.05-0.2 μm.

When the photosensitive layer 57 is made up of the layered charge generation layer 54 and charge transfer layer 55, and an inorganic material is used as the material for the photoconductive layer, the charge generation layer 54 may be formed with the use of the following method. More particularly, it may be formed with a chalcogenide compound such as selenium, arsenic selenide or the like, silicon, germanium, cadmium sulfide or the like by evaporation, painting, CVD process or the like. In this case, the thickness of the charge generation layer 54 is desired to be in a range of 0.1-10 μm.

For the formation of the charge transfer layer 55, a compound formed by dissolving a material capable of moving positive holes, into a resin which can be formed into film. As the choices of the material capable of moving positive holes, chemical compounds, the main or side chain of which has a polycyclic aromatic structure, can be listed. The positive hole transporting material may be a chemical compound comprising a chemical compound having a nitrogen-containing ring structure as the main chain or side chain. The nitrogen-containing ring structure material may be indole, carbazole, oxadiazole, iso-oxadiazole pigment, thiazole, imidazole, pyrazole, oxadiazole, pyrazoline, thiadiazole, triazole or the like, for example. The positive hole transporting material may be a hydrazone compound, for example. The resin material suitable for the formation into film includes polybarbonate, polyallylate, polystyrene, polymetacrylate ester, styrene-methylmethacrylate copolymer, polyester, styrene-acrylonitrile copolymer, polysulfone, or the like resin material. Incidentally, the reason for the addition of one of the resins which can be formed into film is that materials capable of transferring electric charge are generally low in molecular weight, being therefore difficult to form into film without the addition of one of the resins which can be formed into film. The thickness of the charge transfer layer 55 is desired in the range of 5-30 μm, preferable in the range of 5-20 μm.

The abovementioned intermediary layer 58 may be structured in a single layer, or in two layers: an electrically conductive layer 52 and an undercoat layer 53.

When the intermediary layer 58 has a monolayer structure, the middle layer may be made of polyvinyl alccohol, polyvinylmethylether, poly-N-vinylimidazole, ethyl cellulose, methyl cellulose, ethylene-acrylate copolymer, casein, gelatine, polyamide, or the like.

When intermediary layer 58 is structured in multiple layers (two layers in this embodiment), the electrically conductive layer 52, which is placed in contact with the electrically conductive substrate 51, is desired to be formed relatively thick to satisfactorily cover the surface defects of the electrically conductive substrate 51. The undercoat layer 52 is formed on the surface of the electrically conductive layer 52. Of the two layers 52 and 51, the electrically conductive layer 52 may be formed of a mixture of an electrically conductive material and one of the abovementioned materials, instead of one of the abovementioned materials alone, in order to reduce the electrically conductive layer 52 in electrical resistance to prevent potential from remaining. The electroconductive material may be a powder of metal such as aluminum, copper, silver, gold, nickel or the like; a powder of carbon, oxide titanium, tin oxide; or the like. The under coating layer 53 may be made of polyvinyl alccohol, polyvinylmethylether-poly-N-vinylimidazole, ethyl cellulose, methyl cellulose, ethylene-acrylate copolymer, casein, gelatine, polyamide or the like.

Figure 4:
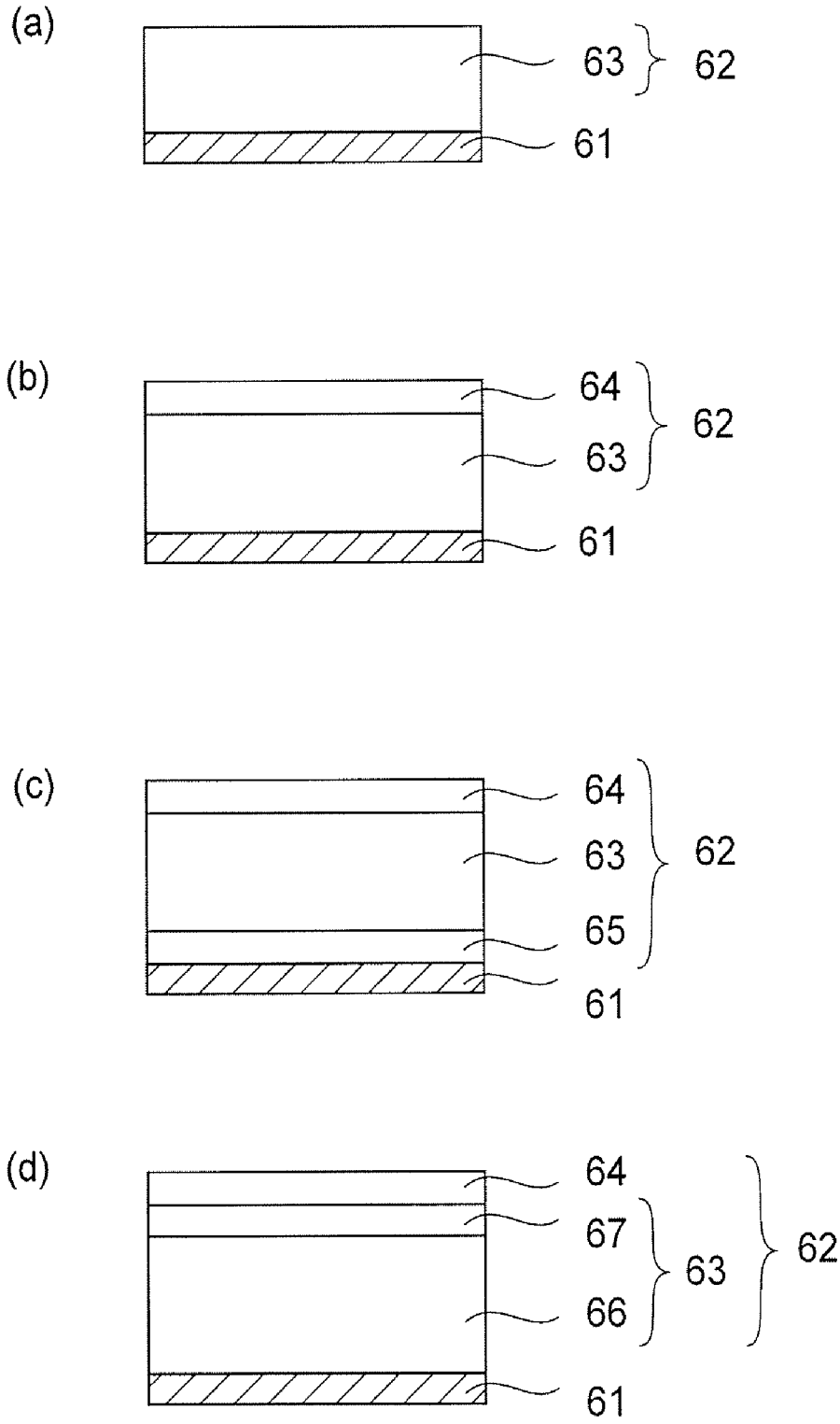
FIG. 4 is a schematic drawing showing other examples of the laminar structure of a photosensitive drum.

Next, a photosensitive member, the main ingredient of which is amorphous silicon, and which therefore is generally called amorphous photosensitive member, will be described. An amorphous photosensitive member has a photoconductive layer formed mainly of amorphous silicon. The amorphous silicon photosensitive member shown in FIG. 4(*a*) has a photosensitive layer supporting member 61, and a photosensitive film 62 formed on the surface of the supporting member 61. The photosensitive film 62 has a photoconductive layer 63 formed of a-Si: H, X (H stands for hydrogen atom, X stands for atom of one of halogens). The amorphous silicon photosensitive member shown in FIG. 4(*b*) has the photosensitive layer supporting member 61, and the photosensitive film 62 formed on the surface of the supporting member 61. This photosensitive film 62, in this case, has a photoconductive layer 63 formed of a-Si: X, X, and a surface layer 64 formed of amorphous silicon. The amorphous silicon photosensitive member shown in FIG. 4(*c*) has the photosensitive layer supporting member 61, and the photosensitive film formed on the surface of the supporting member 61. This photosensitive film 62 has a photoconductive layer 63 formed of a-Si: H, X, a surface layer 64 formed of amorphous silicon compound, and a charge injection prevention layer 65 formed of amorphous silicon compound. The amorphous silicon photosensitive member shown in FIG. 4(*d*) has the photosensitive layer supporting member 61, and the photosensitive film 62 formed on the surface of the supporting member 61. This photosensitive film 62 has the photoconductive layer 63 and the surface layer 64 formed of amorphous silicon compound. This photoconductive layer 63 has a charge generation layer 66 formed of a-Si: H, X, and charge transfer layer 67.

These layers, that is, the photoconductive layer, surface layer, charge injection prevention layer, charge transfer layer, etc., may be those which make up an ordinary amorphous silicon photosensitive member. The supporting member used for an amorphous silicon photosensitive member may be electrically conductive or dielectric. The electroconductive supporting member may be made of metal such as Al, Cr, Mo, Au, In, Nb, Te, V, Ti, Pt, Pd, Fe or the like; an alloy of them such as stainless steel or the like. The supporting member may be treated for electroconductivity at least at the surface thereof on which the photosensitive film is formed, with synthetic resin material film or sheet of polyester, polyethylene, polybarbonate, cellulose acetate, polypropylene, polyvinyl chloride, polystyrene, polyamide or the like, glass, ceramic or the like.

When the photosensitive film 62 is provided with the surface protection layer (surface layer), the surface protective layer is considered to be a part of the photosensitive layer. Further, the photosensitive film includes all the layered coated on the electrically conductive substrate (photosensitive layer supporting member).

Incidentally, in this embodiment, an organic photosensitive member having the electrically conductive substrate 51 (photosensitive layer supporting member), intermediary layer 58 (electrically conductive layer 52, undercoat layer 53), photosensitive layer 57 (charge generation layer 54, charge transfer layer 55, and surface protection layer 58) is used as the photosensitive drum 1 for each of the image formation stations Pa, Pb, Pc, Pd, and Pt.

[Developing Device]

Next, the developing device 4 will be described in detail. In this embodiment, the image formation stations Pa, Pb, Pc, Pd, and Pt are practically the same in structure; they are different only in the color of the tone they use. The structure of the developing device 4 in this embodiment is not different from that of an ordinary developing device which uses two-component developer.

That is, the developing device 4 has a container (developing device housing) in which developer is stored. In the container, two-component developer, which is a mixture of nonmagnetic toner (toner) and magnetic carrier (carrier) is stored. The container has an opening, which faces the photosensitive drum 1. A development sleeve, which is a developer bearing member, is rotatably disposed in the container, being partially exposed through the opening. The development sleeve is formed of a nonmagnetic material. In the hollow of the development sleeve, a stationary magnetic roll, which is a magnetic field generating means, is disposed. Also in the container, a pair of stirring screws which are developer stirring-and-conveying members is disposed. The developer in the container is circularly conveyed in the container while being stirred by the stirring-and-conveying screws.

When the developing device 4 is in operation, the developer, that is, the mixture of the carrier particles, and the toner particles having adhered to the surfaces of the carrier particles, is supplied to the peripheral surface of the development sleeve. The developer on the development sleeve is regulated in amount by a developer regulating member. As the developer on the development sleeve is conveyed to the development area in which it faces the photosensitive drum 1, it is made to crest by the magnetic field generated by the abovementioned magnetic roll, forming thereby a magnetic brush. As this magnetic brush is placed virtually in contact, or actually in contact, with the peripheral surface of the photosensitive drum 1, the toner in the developer is supplied to the peripheral surface of the photosensitive drum 1 in a manner to mirror (reversely, in this embodiment) the electrostatic image on the peripheral surface of the photosensitive drum 1. In this process, development bias which is a combination of DC and AC voltages is applied to the development sleeve from an unshown development bias power source. After the development of the electrostatic image, the developer remaining on the development sleeve is returned to the container by the subsequent rotation of the development sleeve to be recovered into the container.

Next, the two-component developer used in this embodiment will be described.

In the developing device 4*a*, 4*b*, 4*c*, and 4*d* of the first, second, third, and fourth image formation stations Pa, Pb, Pc, and Pd, color toners formed basically of resin and pigment are stored, respectively. On the other hand, in the developing device 4*p* of the fifth image formation station Pt, transparent toner formed basically of resin is stored.

More specifically, the color toner is made up of particles of a colored resin which contains binder resin and coloring agent. The transparent toner is high in transmittance, and is made up of particles of a resin which does not contain coloring agent. To the toner, additives (external additive such as micro-particles of colloidal silica) are added as necessary. As the choices of the color and transparent toners, any of the known toners may be used as fits. In this embodiment, the toner is made up basically of polyester resin, which normally is chargeable to the negative polarity. The volume average particle diameter of the toner is desired to be no less than 5 μm and no more than 8 μm. In this embodiment, it was 7.0 μm.

As the preferable materials for the carrier, iron, nickel, cobalt, manganese, chromium, some rare-earth metals, and their alloys, which are surface-oxidized or not surface-oxidized, ferrous oxide, and the like can be used. There is no specific requirement regarding the method for manufacturing magnetic particles using the abovementioned materials. The volume average particles diameter of the carrier is desired to be in a range of 20-50 μm, preferably, a range of 30-40 μm. The carrier is desired to be no less than $10^7$ ohm.cm, preferably, no less than $10^8$ ohm.cm. In this embodiment, a carrier which is 35 μm in volume average particle diameter, $5\times10^9$ ohm.cm, and 200 emu/cc in the amount of magnetization, was used.

In order to keep constant the toner ratio (or amount of toner) in each developing device 4, the developing devices 4*a*, 4*b*, 4*c*, 4*d*, and 4*t* are supplied with toner from unshown toner hoppers, one for one, with a preset timing, as necessary.

[Prevention of Toner Scatter and Carrier Adhesion]

This embodiment is characterized in that the transparent toner is used to form an image, the entirety of which is uniform in glossiness. Next, the structural arrangement for preventing the transparent toner from scattering, and the carrier from adhering to the photosensitive member which bears the transparent toner, will be described.

Figure 2:
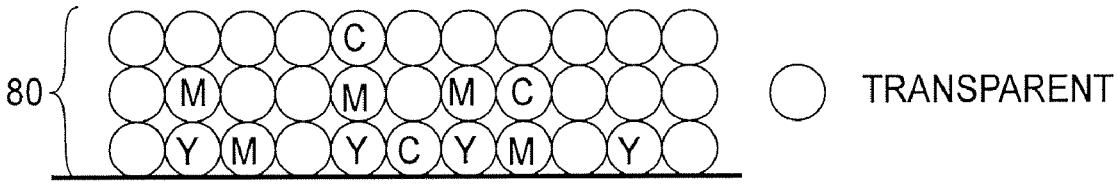
FIG. 2 is a schematic drawing of a toner image.

FIG. 2 is a schematic drawing of the toner layers formed on the recording medium S. In this embodiment, the maximum total amount by which color toners are adhered, in layers 80, to the recording medium S by layering the color toner images (yellow (Y), magenta (M), cyan (C), and black (K) toner images), is set to 1.5 mg/cm$^2$. Further, the maximum amount by which each color toner is adhered to the recording medium S is set to 0.5 mg/cm$^2$. Incidentally, FIG. 2 schematically shows a full-color image formed by placing in layers yellow (Y), magenta (M), cyan (C), and black (K) toner images on the recording medium S, although in some areas, not all the toner images were layered. Incidentally, the portions of the image, which are made up of the layered yellow (Y), magenta (M), and cyan (C) toner images, can be partially or entirely replaced with the black toner image, as is a commonly practice when forming a color image. Further, a black monochromatic image can be formed using only black (K) toner.

Further, in this embodiment, during the formation of a full-color image, the entirety of the image is rendered uniform in the amount of toner per unit area, by transferring the transparent toner so that the total amount of toner (combination of color toner and transparent toner) per unit area of the recording medium S becomes 1.5 mg/cm$^2$. With the employment of this practice, it is possible to yield an image which is entirely uniform in glossiness. In other words, the transparent toner is transferred onto the blank portions of the image formation area of the recording medium S, that is, the portions of the image formation area of the recording medium S, to which no color toner is transferred, by such an amount that makes the total amount of toner per unit area of these areas become 1.5 mg/cm$^2$. Incidentally, it has been well-known that an image can be made uniform in glossiness by rendering the toner image uniform in thickness, that is, the amount of toner per unit area.

More specifically, the maximum amount by which the transparent toner is transferred onto the intermediary transfer belt 12, which is the object onto which the toners are transferred, per transfer and per unit area, is greater than the maximum amount by which each color toner is transferred onto the same object, per transfer and per unit area. This relationship holds true regarding the relationship between the maximum amount by which the transparent toner is adhered to the image bearing member, and the maximum amount by which each color toner is adhered to the image bearing member. In the case of an image forming apparatus of the intermediary transfer type, such as the image forming apparatus 100 in this embodiment, the first object (transfer medium) onto which toner is transferred from the photosensitive drum 1 is the intermediary transfer belt 12. The relationship between the maximum amount of the transparent toner transferred (primary transfer), per transfer, onto the intermediary transfer belt 12, per unit area, and the maximum amount of each color toner transferred, per transfer, onto the intermediary transfer belt 12 per unit area, is practically the same as the relationship between the maximum amount of the transparent toner and the maximum amount of each color toner on the recording medium S after the transfer (second transfer) of the transparent toner and color toner onto the recording medium S from the intermediary transfer belt 12. In the case of an image forming apparatus of the direct transfer type, the object (transfer medium) onto which toner is transferred from the photosensitive drum 1 is the recording medium S itself. Thus, when the transparent toner is used to form an image which is uniform in glossiness, the relationship between the maximum amount of the transparent toner and the maximum amount of each color toner on the recording medium S is similar to the above described relationship (amount of transparent toner is greater than that of each color toner).

Figure 5:
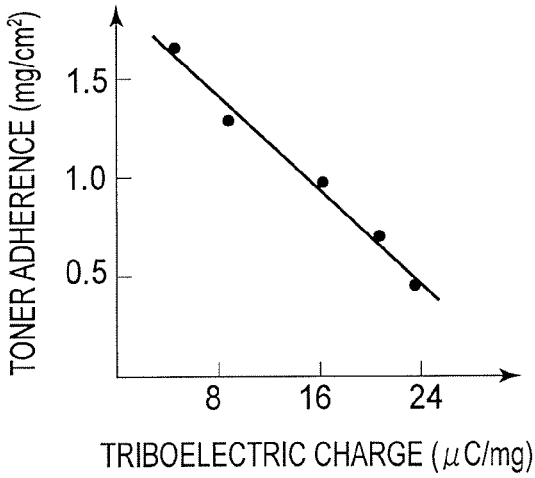
FIG. 5 is a graph showing the relationship between the amount of the triboelectric charge of toner and the amount by which the toner is adhered to recording medium.

FIG. 5 is a graph showing the relationship between the amount of the triboelectric charge (amount of electric charge per unit weight) of the transparent toner, and the amount by which the toner was adhered to the recording medium S per development process in which electrostatic image is developed using the transparent toner. Incidentally, the results shown in FIG. 5 were obtained with the contrast potential set to 300 V.

As is evident from FIG. 5, the amount of transparent toner on the recording medium S has a virtually linear relationship with the amount of the triboelectric charge of the toner, and when the amount of the triboelectric charge of the toner was 6.3 μC/g, the amount of the toner transferred onto the recording medium S per development process was 1.5 mg/cm$^2$. However, when the amount of the triboelectric charge of the toner is no higher than 6.3 μC/g, the toner is likely to scatter, and therefore, the interior of the image forming apparatus 100 is likely to be contaminated by the toner. This phenomenon is thought to occur because the amount of centrifugal force generated by the rotational movement of the development sleeve is greater than the amount of electrostatic force which keeps toner particles held to carrier particles.

In order to prevent the toner from scattering in the image forming apparatus 100 in this embodiment, the amount of the triboelectric charge of the toner is desired to be no less than 18 μC/g, preferably, no less than 20 μC/g, in consideration of the durability of the carrier.

Figure 6:
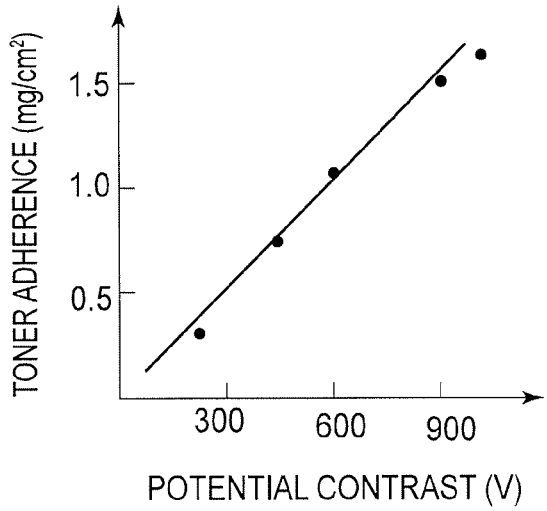
FIG. 6 is a graph showing the relationship between the amount of the contrast potential and the amount by which the toner is adhered to the recording medium.

FIG. 6 is a graph showing the correlation between the contrast potential and the amount by which the toner was adhered to the recording medium S per development of an electrostatic latent image by the transparent toner. Incidentally, the results shown in FIG. 6 were obtained by setting the amount of triboelectric potential to 25 μC/g which is large enough to prevent the toner from scattering, as described above.

As is evident from FIG. 6, the amount by which the transparent toner was adhered to the recording medium S has a roughly linear relationship to the amount of the contrast potential, and when the amount of the contrast potential was 900 V, the amount by which the transparent toner was adhered to the recording medium S per development was 1.5 mg/cm$^2$. However, it is thought that when the contrast potential is as large as 900 V, the carrier is likely to adhere to the peripheral surface of the photosensitive member for the following reason. That is, when the contrast potential is as large as 900 V, a large amount of electric charge is injected from the carrier into the photosensitive member, and therefore, the mirror force between the carrier and photosensitive member increases. As the carrier having adhered to the photosensitive member is transferred onto the recording medium S, an image, the blank areas of which are strewn with minute black spots, is formed; an image which is extremely poor in quality is formed.

In the case of the image forming apparatus 100 in this embodiment, the amount of the contrast potential below which the carrier adhesion to the photosensitive member does not occur is 550 V; the contrast potential is desired to be no more than 500 V.

It became evident that it was difficult to form, on the recording medium S, a transparent toner image, which is 1.5 mg/cm$^2$ in weight, while preventing the toner scatter and carrier adhesion, with the use of the method for controlling the amount of the triboelectric charge of the toner, or the method for adjusting the amount of the contrast potential, as described above.

In this embodiment therefore, the image forming apparatus 100 is provided with the following structural feature. That is, the image forming apparatus 100 is provided with the first developing device 4*t* for forming a transparent toner image by supplying an electrostatic image formed on the first image bearing member 1*t* (photosensitive member for transparent toner), with the transparent toner. Further, image forming apparatus 100 has the second developing devices 4*a*, 4*b*, 4*c*, and 4*d* for forming color toner images by supplying color toners to the electrostatic images formed on the second image bearing members 1*a*, 1*b*, 1*c*, and 1*d* (photosensitive members for color toners), respectively. The image forming apparatus 100 also has a first transferring means 5*t* for transferring the transparent toner image formed on the first image bearing member 1*t*, onto the transfer medium 12 (intermediary transfer belt). Further, the image forming apparatus 100 has second transferring means 5*a*, 5*b*, 5*c* and 5*d* for transferring the color toner images formed on the second image bearing members 1*a*, 1*b*, 1*c*, and 1*d*, onto the transfer medium 12 (intermediary transfer belt). Moreover, the image forming apparatus 100 has the function of forming such a transparent toner image that makes the combination of the toner layers on the intermediary transfer belt 12 uniform in thickness (level across top surface). Here, the electrostatic capacity, per unit area, of the first image bearing member 1*t* (photosensitive member for transparent toner) which bears the transparent toner image is rendered greater than that of each of the second image bearing members 1*a*, 1*b*, 1*c* and 1*d* (photosensitive members for color toners). Further, the maximum amount by which the transparent toner is transferred, per transfer, onto the transfer medium 12 (intermediary transfer belt) per unit area is rendered greater than the maximum amount by which each of the color toners is transferred, per transfer, onto the transfer medium 12 (intermediary transfer belt) per unit area. In other words, the maximum amount of toner transferred onto the first image bearing member 1*t* to form a toner image is greater than the maximum amount of each color toner transferred onto the second image bearing member 1*a*, 1*b*, 1*c*, or 1*d* to form a toner image.

To describe in more detail, in the case of the image forming apparatus 100 in this embodiment, in order to achieve a proper amount of triboelectric charge and a proper amount of contrast potential for preventing the toner scatter and carrier adhesion, the electrostatic capacities of the image bearing members were set as follows. That is, in terms of the electrostatic capacity of the photosensitive drum 1, which is an image bearing member, and the electrostatic capacity of the photosensitive film 59 of the photosensitive drum 1, the photosensitive drum 1*t* which bears the transparent toner is rendered greater than each of the photosensitive drums 1*a*, 1*b*, 1*c*, and 1*d* which bear color toners one for one. With the employment of this setup, the maximum amount by which transparent toner is adhered to the recording medium S is set to 1.5 mg/cm$^2$. Thus, even if the contrast of the photosensitive drum for the transparent toner is set to roughly the same value as that of each of the photosensitive drums for the color toners, the transparent toner side can be rendered greater than the color toner side, in terms of the maximum amount by which toner is adhered to the photosensitive drum.

More specifically, it is evident from the following equation that all that is necessary to increase the electrostatic capacity of a photosensitive member is to reduce the thickness of the photosensitive film 59 of the photosensitive drum 1, provided that the specific inductive capacity is constant. That is, the electrostatic capacity of the photosensitive film 59 of the photosensitive drum 1 (which hereafter will be referred to simply as "electrostatic capacity of photosensitive member"), specific inductive capacity of the photosensitive film 59 of the photosensitive drum 1 (which hereafter will be referred to simply as "specific inductive capacity of photosensitive member"), thickness of the photosensitive film 59 of the photosensitive drum 1 (which hereafter will be referred to simply as "film thickness of photosensitive member"), and surface area size of the photosensitive film 59 of the photosensitive drum 1 (which hereafter will be referred to simply as "surface area size of photosensitive member") have the following correlation:

$$C=\epsilon \times S/d$$

Figure 7:
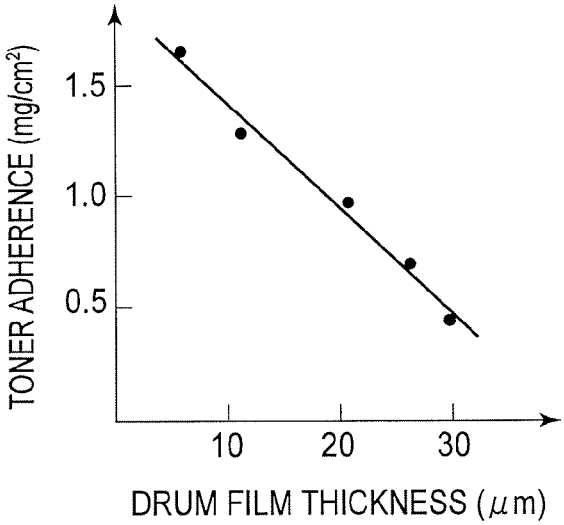
FIG. 7 is a graph showing the relationship between the film thickness of a photosensitive drum and the amount by which the toner is adhered to the recording medium.

C: electrostatic capacity of photosensitive member $\epsilon$: specific inductive capacity of photosensitive member d: film thickness of photosensitive member S: surface area size of photosensitive member FIG. 7 is a graph showing the correlation between the film thickness of the photosensitive member and the amount by which toner was adhered to the recording medium S when the film thickness of the photosensitive member was varied while the contrast potential was kept constant.

As is evident from FIG. 7, under the above described conditions, the relationship between the film thickness of the photosensitive member and the amount by which toner was adhered is roughly linear; reducing the film thickness of the photosensitive member to ⅓ triples the amount by which toner is adhered.

That is, in this case, the film thickness of the photosensitive member for the transparent toner is reduced to ⅓ of that of the photosensitive member for each of the color toners. With the employment of this setup, it was possible to achieve 1.5 mg/cm$^2$ (three times the maximum amount (0.5 mg/cm$^2$) by which each of the color toners is transferred onto recording medium S), which was the maximum amount of the transparent toner necessary to be transferred per development.

Incidentally, in the case of the image forming apparatus 100 in this embodiment, onto the portions of the image formation area of the recording medium S, which correspond to the portions of the image, which is smaller in the amount of the color toner, the transparent toner is transferred so that the total amount of the color toners and transparent toner on these portions of the recording medium S will become 1.5 mg/cm$^2$. Further, onto the portions of the image formation area of the recording medium S, which correspond to the blank portions of the image, the transparent toner is transferred so that the total amount of the transparent toner on these portions of the recording medium S will becomes 1.5 mg/cm$^2$. With the employment of this setup, it is possible to yield an image, which is virtually perfectly uniform in glossiness. As described above, it is desired that after the completion of the formation of an image, the total amount of toner per unit area of the recording medium S roughly equals the maximum total amount by which the color toners are adhered in layers per unit area of the recording medium S. In other words, in this case, after the formation of the full-color toner image on the recording medium S, the maximum amount of the toner per unit area of the full-color toner image on the recording medium S is roughly equal to the maximum amount of the transparent toner per unit area of the blank portion of the image formation area of the recording medium S.

However, this embodiment described above is not intended to limit the present invention in scope. For example, even if the maximum amount by which the transparent toner is adhered to the blank area of the image formation area of the recording medium S is set to roughly 1.2 g/cm$^2$, it is possible to achieve a level of glossiness which is high enough not to negatively affect image quality. The maximum amount by which the transparent toner is to be adhered to the recording medium S by a given image forming apparatus may be set to a proper value according to the properties of the image forming apparatus.

However, even when the maximum amount by which the transparent toner is adhered to the blank portions of the image formation area of the recording medium S by the image forming apparatus 100 in this embodiment is set to roughly 1.2 g/cm$^2$, for example, the transparent toner is still likely to scatter and/or the carrier is still likely to adhere to the photosensitive member for the transparent toner. Therefore, making the film thickness of the photosensitive member for the transparent toner roughly ⅓ of that of the photosensitive member for the photosensitive member for the color toner, as described above, is extremely advantageous.

That is, as long as the maximum amount by which the transparent toner is to be adhered to the blank portion of the image formation area of the transfer recording is within a range of 0.8-1.0 times the product of 3× the maximum amount by which each color toner (yellow, magenta, and cyan) is adhered to the image formation area of the transfer medium, there will be no problem. In other words, all that is necessary is for the maximum amount of the transparent toner per unit area of the image formation area of the transfer medium to be 0.8-1.0 times the maximum total amount by which the color toners are adhered to the transfer medium to form a full-color image without the transparent toner layer.

Also in this embodiment, the three times the maximum amount by which each color toner is adhered to the recording medium S is set to the maximum total amount by which the color toners are transferred in layers onto the recording medium S. This relationship between the maximum amount by which each color toner is transferred onto a given transfer medium and the maximum total amount by which the color toners are transferred onto the same transfer medium does not substantially vary whether the transfer medium is the recording medium S, intermediary transfer member, or photosensitive member. Further, the maximum amount by which the transparent toner is to be adhered to the transfer medium is set to the largest value achievable without causing the toner scatter and carrier adhesion, and the electrostatic capacity of the photosensitive member for the transparent toner is made larger than that of the electrostatic capacity of the photosensitive member for each color toner. However, the maximum total amount by which the color toners are adhered to the recording medium S may be set according to the color reproduction range achievable by the proper combination of cyan, magenta, yellow, and black toners. Normally, a full-color image forming apparatus is designed so that two to three times the maximum amount by which each color toner is adhered to the recording medium S to achieve the maximum level of density is equal to the maximum total amount by which the color toners are placed in layers on the recording medium S. The relationship between the electrostatic capacity of the photosensitive member for the transparent toner and the electrostatic capacity of the photosensitive member for each color toner (how large the former is made relative to the latter) may be altered according to the maximum total amount by which the color toners are adhered to the recording medium S. Normally, it is desired that the electrostatic capacity of the photosensitive member for the transparent toner is set to be 2-3 times the electrostatic capacity of the photosensitive member for the color toner.

In this embodiment, the film thickness of the photosensitive member was reduced by reducing the thicknesses of the charge transfer layer 55 and surface protection layer 56 shown in FIG. 3. More specifically, the thicknesses of the charge transfer layer 55 and surface protection layer 56 of the photosensitive member for the color toner were set to 10 μm and 20 μm, respectively. In comparison, the thicknesses of the charge transfer layer 55 and surface protection layer 56 of the photosensitive member for the transparent toner were set to 5 μm and 5 μm, respectively. The film thickness of the photosensitive member for the transparent toner was roughly ⅓ of that of the photosensitive member for the color toner. With the employment of this setup, the electrostatic capacity per unit area of the photosensitive member for the transparent toner (roughly 450 pF/cm$^2$)was made to be roughly three times the electrostatic capacity per unit area of the photosensitive member for the color toner (roughly 150 pF/cm$^2$). Incidentally, the material used as the material for the photosensitive member for the transparent toner was the same as that for the photosensitive member for the color toner.

With the employment of the above described design, it was possible to form a full-color image which is entirely uniform in thickness, being therefore entirely uniform in glossiness, by making the maximum amount by which the transparent toner was adhered to the recording medium S roughly three times the maximum amount by which each color toner was adhered to the recording medium S.

Incidentally, the electrostatic capacity of a photosensitive member can be measured with the use of the following procedure. The electrostatic capacity is obtained as that per unit area of a photosensitive member. The electrostatic capacity of a photosensitive member is affected by the inductive capacity of the film layer of the photosensitive member, which is formed of the mixture of various materials, and the thickness of the film layer.

Figure 8:
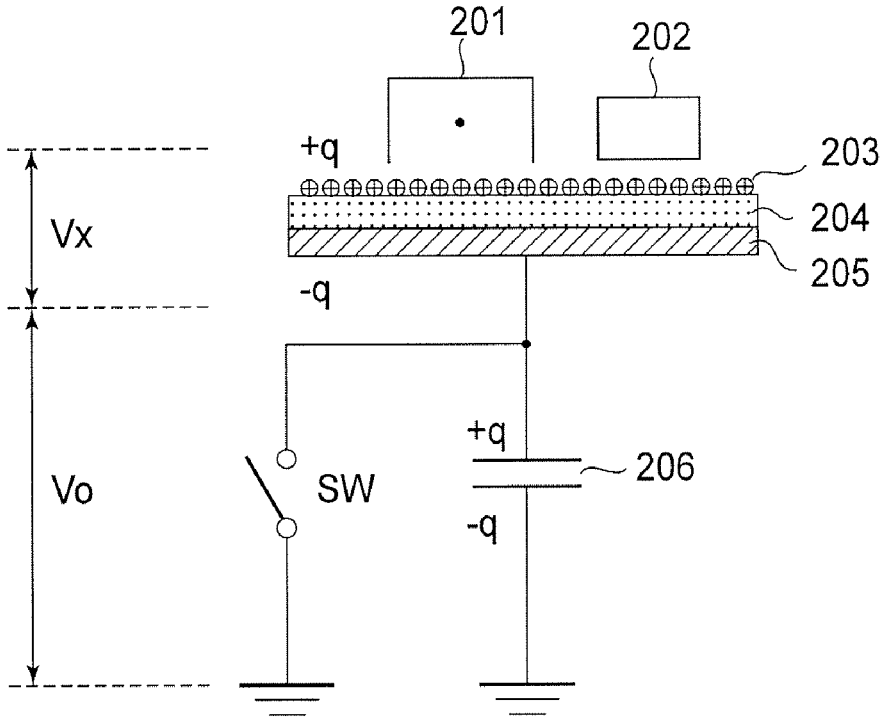
FIG. 8 is a schematic drawing of an apparatus for measuring electrostatic capacity.

FIG. 8 is a schematic drawing of the electrostatic capacity measuring apparatus. The method for measuring electrostatic capacity is as follows:

1) A sample 204 (photosensitive member), the electrostatic capacity (Cx) of which is to be measured, and a condenser 206, the electrostatic capacity ($C_0$) of which is known, is connected as shown in FIG. 8, and the sample 204 is charged by a corona discharger to which a preset DC voltage is being applied.
2) The surface potential of the sample 204 is measured by a surface potentiometer 202, with a switch SW turned off. The obtained surface potential value of the sample 204 will be referred to as V1.
3) Next, the surface potential of the sample 204 is measured again with the surface potentiometer 202, with the switch SW kept on this time. The surface potential value of the sample 204 obtained this time will be referred to as V2.

The electrostatic capacity Cx of the sample 204 can be calculated with the use of the following equation:

$$V1=V0+Vx=q/C_0+q/Cx \quad (1)$$

$$V2=Vx=q/Cx \quad (2)$$

eliminating q from the above equations (1) and (2)

$$Cx=[(V1-V2)/V2]\cdot C_0$$

The electrostatic capacity per unit area of the sample 204 can be obtained by dividing the obtained electrostatic capacity Cx with the surface area size of the sample 204. Referential symbols 203 and 205 denote the electric charge and electrode, respectively.

Incidentally, the process for transferring the transparent toner can be reduced in the number of steps by the present invention. This embodiment was described above with reference to a single process for transferring the transparent toner. However, the application of the present invention is not limited by the number of the transparent toner transferring processes. Moreover, even if the number of the color toners is increased by the addition of toners of light color or the like, the same effects as those described above can be obtained by controlling the relationship between the electrostatic capacity and the amount by which toners are adhered to the recording medium S, according to the present invention, as described above.

As described above, this embodiment makes it possible to increase the maximum amount by which the transparent toner is adhered to the transfer medium, without extremely increasing the contrast potential.

Embodiment 2

Next, another preferred embodiment of the present invention will be described. The basic structure and operation of the image forming apparatus in this embodiment are the same as those of the image forming apparatus in the first embodiment. Therefore, the components of this image forming apparatus, which are practically the same in structure and operation as those of the image forming apparatus in the first embodiment are given the same referential symbols as those given to describe the first embodiment, and will not be described in detail.

In this embodiment, the electrostatic capacity of the photosensitive member for the transparent toner is made greater than that of the photosensitive member for the color toner, by making the specific inductive capacity of the photosensitive member for the transparent toner greater than that of the photosensitive member for the color toner, while keeping the two photosensitive member the same in film thickness. Incidentally, the developing devices, developers, image forming apparatus itself, etc., are the same in structure as those in the first embodiment.

As described above, the electrostatic capacity of a photosensitive member, specific inductive capacity of photosensitive member, film thickness of photosensitive member, and surface area size of photosensitive member have a correlation that satisfies the following equation:

$$C=\epsilon S/d$$

C: electrostatic capacity of photosensitive member
$\epsilon$: specific inductive capacity of photosensitive member
d: film thickness of photosensitive member
S: surface area size of photosensitive member In this embodiment, therefore, the electrostatic capacity of the photosensitive member for the transparent toner can be made greater than that for the photosensitive member for the color toner by making the specific inductive capacity of the photosensitive member for the transparent toner greater than that of the photosensitive member for the color toner, while keeping the photosensitive member for the transparent toner roughly the same in film thickness as the photosensitive member for the color toner.

Figure 9:
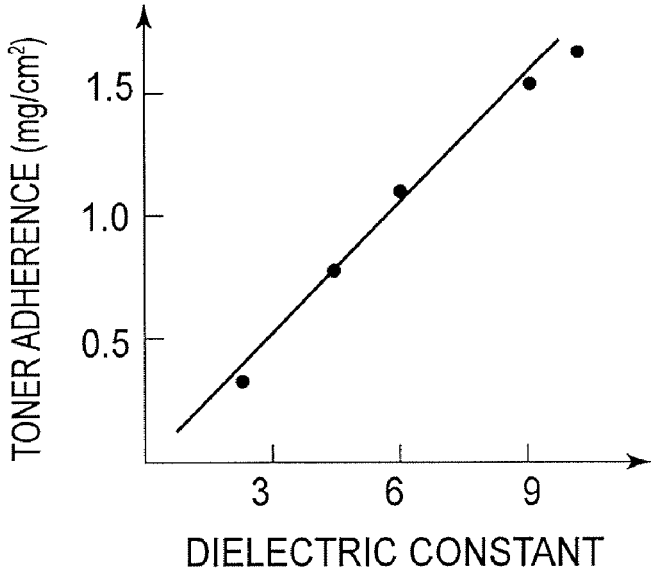
FIG. 9 is a graph showing the relationship between the relative dielectric constant and the amount by which the toner is adhered to recording medium.

FIG. 9 is a graph showing the correlation between the specific inductive capacity of a photosensitive member and the amount by which toner was adhered to the transfer medium when the photosensitive member was varied in specific inductive capacity while the contrast potential was kept constant.

As is evident from FIG. 9, under the above described conditions, the relationship between the specific inductive capacity of the photosensitive member and the amount by which toner was adhered to the transfer medium is roughly linear; tripling the specific inductive capacity of a photosensitive member roughly triples the amount by which toner is adhered to the transfer medium. That is, in this embodiment, the maximum amount of 1.5 mg/cm$^2$ by which the transparent toner is adhered to the transfer medium per development can be achieved by tripling the specific inductive capacity of the photosensitive member.

All that is necessary to change the specific inductive capacity of a photosensitive member is to change the materials for the photosensitive member. In this embodiment, the same organic photosensitive member as the one in the first embodiment was employed as the photosensitive member for the color toner, whereas, as the photosensitive member for the transparent toner, a so-called amorphous photosensitive member, the main ingredient of which is amorphous silicon, was employed.

More specifically, in this embodiment, the specific inductive capacity of the organic photosensitive member for the color toner was roughly 3, whereas that of the amorphous photosensitive member for the transparent toner was roughly 10. That is, the specific inductive capacity of the photosensitive member for the transparent toner was roughly three times the specific inductive capacity of the photosensitive member for the color toner. With the employment of this setup, the electrostatic capacity per unit area of the organic photosensitive member for the transparent toner was roughly three times that of the photosensitive member for the color toner.

With the employment of the above described design, it was possible to yield a full-color image which was entirely uniform in thickness, being therefore entirely uniform in glossiness, by making the maximum amount by which the transparent toner is adhered to the recording medium S three times that by which each color toner is adhered to the recording medium S.

The specific inductive capacity of a photosensitive member was measured using the following method:

<Measuring Device>

LCR meter: HP4284A Precision LCR meter (product of Hewlett Packard Co., Ltd.)

electrode: inductive capacity measurement electrode HP16451B (produce of Hewlett Packard)

electrode type: C

<Sample>

A photosensitive member is prepared, and a part of the photosensitive member is cut out to obtain a sample piece which is 56 mm in diameter. After the cutting, the obtained sample piece was provided with a primary electrode, which is 50 mm in diameter, and a guard electrode which is 51 mm in internal diameter, by vapor-depositing Pt—Pd. The Pt—Pd film was obtained by operating a mild sputter E1030 (product of Hitachi Co., Ltd.) for two minutes. The sample piece put through the abovementioned process of vapor deposition was used as the final sample used for the measurement of the specific inductive capacity of a photosensitive member.

<Measurement Conditions>

Measurement Ambience: 22-23° in temperature and 50-60% in humidity.

Incidentally, the measurement sample is to be left in advance as it is, in the ambience which is 22-23° in temperature and 50-60% in humidity, for no less than 24 hours.

Voltage Applied for Measurement: 1 Vpp (Automatic level control of HP4284A is kept on)

Frequency: 100 Hz

Measurement Mode: CP-RP or CP-D

<Formula for Calculating Specific Inductive Capacity>

$$\text{Specific inductive capacity } \epsilon = t \times CP/(1.738 \times 10^{14})$$

t: thickness of sample (measured in meter; thickness of aluminum sheet is not included. The unit of measurement for CP is F (farad).

As described above, according to this embodiment, an image which is entirely uniform in glossiness can be obtained by using the transparent toner in addition to color toners, while preventing the scatter of the transparent toner, which leads to the contamination of the interior of an image forming apparatus, and the adhesion of the transparent toner to a photosensitive member, which leads to the formation of an image inferior in quality.

Embodiment 3

Next, another embodiment of the present invention will be described. The basic structure and operation of the image forming apparatus in this embodiment are the same as those of the image forming apparatus in the first embodiment. Therefore, the components of this image forming apparatus, which are practically the same in structure and operation as those of the image forming apparatus in the first embodiment are given the same referential symbols as those given to describe the first embodiment, and will not be described in detail.

As a means for carrying out a process for uniformly charging a photosensitive member to preset polarity and potential level, a charging device based on corona discharge (which hereafter may be referred to as corona discharging device) has been widely used. A charging device based on corona discharge is a corona charging device. It is disposed in a manner to oppose a photosensitive member, with no contact between the charging device and the photosensitive member. The surface of the photosensitive member is charged by being exposed to the corona (corona shower) discharged from the corona discharging device to which high voltage is being applied. Incidentally, even when a roller which is placed in contact with a photosensitive member is used as a charging means, the photosensitive member is charged by the electric discharge which occurs in the minute space between the roller and photosensitive member.

As described above, the maximum total amount by which the color toners (yellow, magenta, cyan, and black toners) are placed in layers on the recording medium S is set to 1.5 $mg/cm^2$. Further, the maximum amount by which each color toner is adhered to the recording medium S is set to 0.5 $mg/cm^2$. With the employment of this setup, it is possible to yield an image which is entirely uniform in glossiness, by making the electrostatic capacity of the photosensitive member for the transparent toner three times that for the color toner, provided that the triboelectric charge of the toners and the contrast potential are set to values in the ranges in which the toner scatter and carrier adhesion do not occur.

Here, the potential of the surface of a photosensitive member, electrostatic capacity between the photosensitive member and a developer bearing member, and contrast potential have a correlation that satisfies the following equation:

$$Q = C \times V$$

Q: amount of electric charge on photosensitive member

C: electrostatic capacity between developer bearing member and photosensitive member V: contrast potential Provided that the contrast potential is kept constant, if the electrostatic capacity of a photosensitive member is tripled, the amount Q of electric charge which is to be given to the photosensitive member must be also tripled according to the above equation. When the charging device for the fifth image formation station Pt is roughly the same in charging performance as the charging devices for the first—fourth image formation stations Pa—Pd, it is sometimes difficult to charge the photosensitive member for the fifth image formation station Pt to a required potential level, for example, in an ambience which is low in humidity, because humidity affects the performance of a charging device. Therefore, when humidity is low, an image suffering from the nonuniformity in glossiness attributable to the nonuniform charging of the photosensitive member is sometimes yielded. Here, a low humidity ambience means an ambience in which humidity is no higher than 20% RH.

To reiterate the objects of this embodiment of the present invention, one of the objects is to form an image entirely uniform in glossiness with the use of the transparent toner in addition to color toners, while preventing the toner scatter which results in the contamination of the interior of an image forming apparatus, and preventing the formation of a low quality image, which is attributable to the adhesion of the carrier to the photosensitive member for the transparent toner. Another object is to prevent the formation of an image suffering from the nonuniformity in glossiness, which is attributable to the nonuniform charging of the surface of the photosensitive member, which is likely to occur when the photosensitive member is increased in electrostatic capacity.

Figure 10:
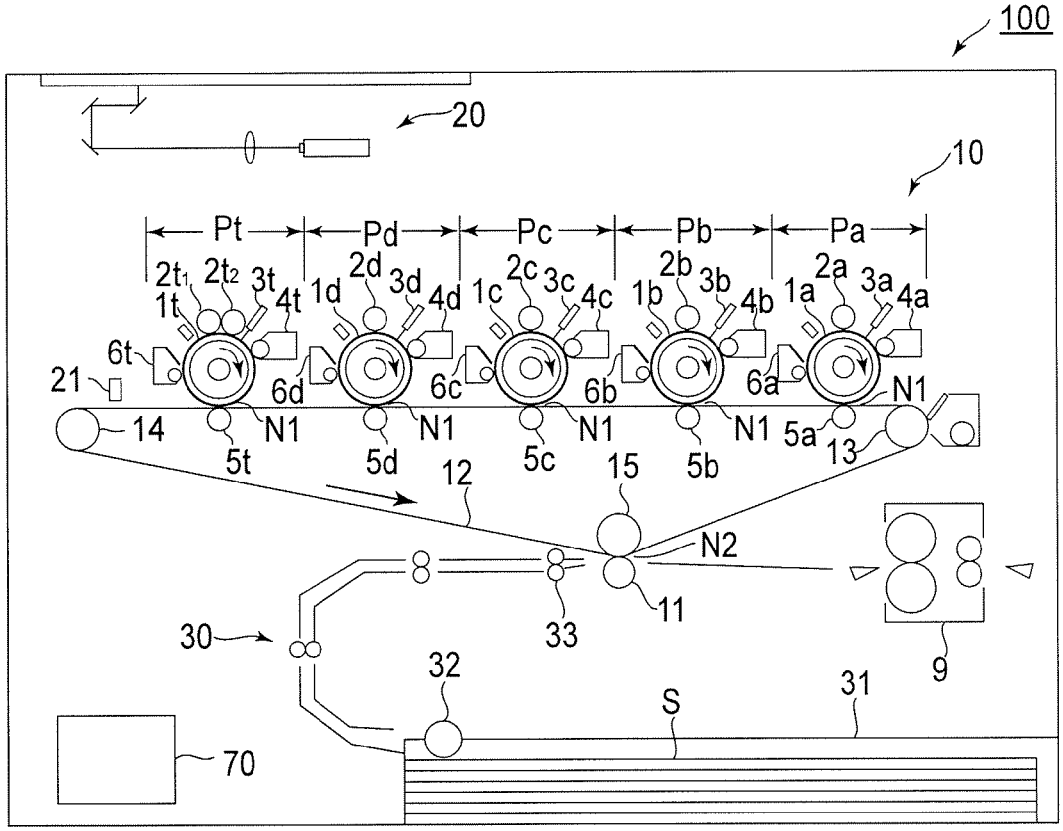
FIG. 10 is a schematic sectional view of the image forming apparatus in another preferred embodiment of the present invention, showing the general structure thereof.

Thus, in this embodiment, the fifth image formation station Pt, which is for forming a transparent toner image, is provided with two charging devices 2*t*1 and 2*t*2 for charging the photosensitive drum it as shown in FIG. 10. Each of the charging devices 2*t*1 and 2*t*2 has the same charging performance as that of each of the charging devices 2*a*-2*d*, with which the first—fourth image formation stations Pa—Pd for forming the color toner images, respectively, are provided. More specifically, control is executed so that 1,000 μm of electric current flows through the wire of each charging device, and 600 V of potential is applied to the grid of each charging device.

In other words, in this embodiment, the fifth image formation station Pt for forming a transparent toner image is provided with multiple charging devices, that is, charging devices 2*t*1 and 2*t*2, as shown in FIG. 10, making it possible to give a photosensitive member a preset amount of electric charge at any humidity level, making it therefore possible to form a toner image entirely uniform in thickness, being therefor entirely uniform in glossiness, at any level of humidity. That is, the provision of the two charging devices 2*t*1 and 2*t*2 for charging the photosensitive member for the transparent toner can solve the problem that when the photosensitive member for the transparent toner is increased in electrostatic capacity, the performance of the charging device for the fifth image formation station Pt cannot match the increased electrostatic capacity of the photosensitive member.

Incidentally, in this embodiment, the charging performance (charge giving performance) of the charging means for charging the photosensitive member for the transparent toner is rendered greater than that of the charging device for charging the photosensitive member for the color toner, by providing the charging means for the charging the photosensitive member for the transparent toner with multiple charging devices. However, as long as an image forming apparatus is structured so that the charging performance of the charging means for charging the photosensitive member for the transparent toner can be made to be greater than that of the charging means for charging the photosensitive member for the color toner, the structure of an image forming apparatus does not need to be limited to the above described one. Further, in this embodiment, the present invention is described with reference to the full-color image forming apparatus realized by modifying the charging means of the fifth image formation station Pt of the image forming apparatus in the first embodiment. However, the structural arrangement in this embodiment is equally applicable to the image forming apparatus in the second embodiment.

As described above, according to this embodiment, the amount by which the transparent toner is adhered to the transfer medium can be increased without extremely increasing the contrast potential. Moreover, it is possible to prevent the formation of an image suffering from the nonuniformity in glossiness, which is likely to be caused by the nonuniformity in the potential of a photosensitive member, which occurs, in a low humidity environment or the like, when the photosensitive member is increased in electrostatic capacity.

The transparent toner is used, in addition to color toners, to make the combination of toner layers uniform in thickness. However, even if the present invention is applied to an image forming apparatus which is operable in the transparent toner saving mode in which the thickness level at which the transparent toner is adhered to the transfer medium is reduced to reduce the consumption of the transparent toner, there will be no problem. When the image forming apparatus is operated in such a mode, it yields an image (which is formed of toner layers), the entirety of which is slightly less uniform in thickness than an image formed in the normal mode.

In the above, the present invention was described with reference to the preferred embodiments of the present invention. However, it is desired to understand that the preferred embodiments described above are not intended to limit the present invention in scope. That is, the materials for the photosensitive member, developer, structure of the image forming apparatus, etc., do not need to be limited to those in the preceding embodiments. Further, the order in which the development process is carried out in the multiple image formation stations, the maximum amount by which the transparent toner is adhered to the transfer medium, etc., do not need to be limited to those in the preceding embodiments.

Figure 11:
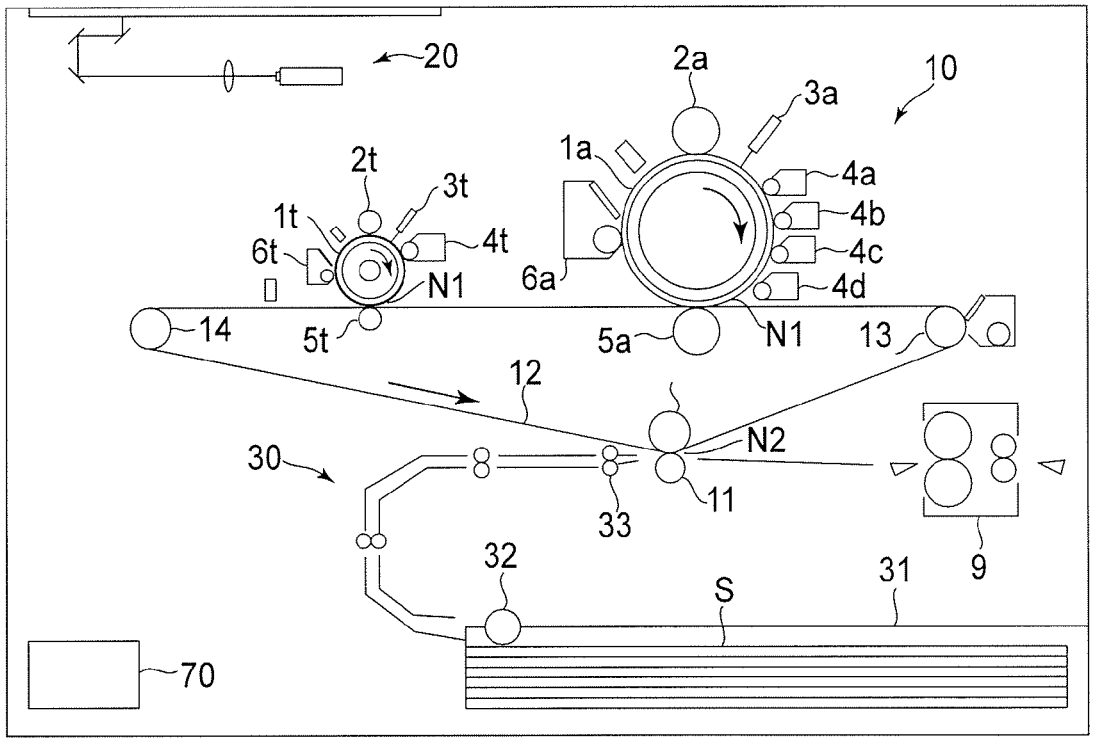
FIG. 11 is a schematic sectional view of another example of an image forming apparatus to which the present invention is applicable.

Further, in each of the preceding embodiments, each photosensitive drum was provided with its own developing device. However, the present invention is also applicable to an image forming apparatus, such as the one shown in FIG. 11, which has an image forming station having a photosensitive drum 1*a* and four developing devices for the four color toners, one for one, and an image formation station having a photosensitive drum 1*t* and a developing device for the transparent toner. In FIG. 11, the components which are the same as, or equivalent to, those of the image forming apparatus 100 shown in FIG. 1, in terms of function and structure, are given the same referential symbols as those given in FIG. 1.

Figure 12:
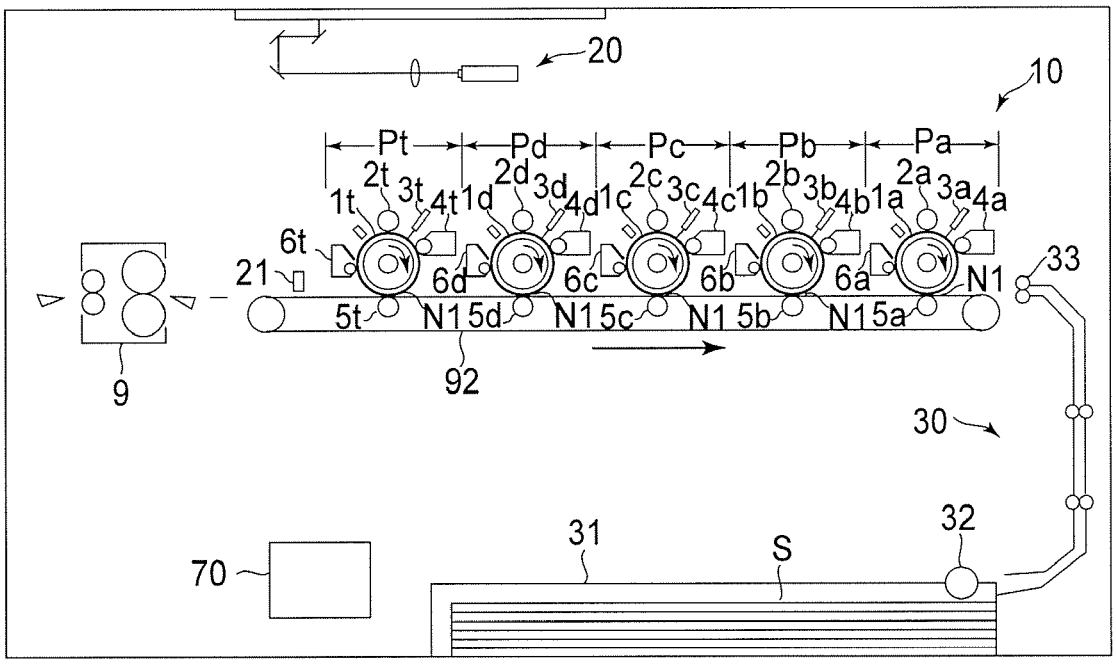
FIG. 12 is a schematic sectional view of yet another example of an image forming apparatus to which the present invention is applicable.

Also in each of the preceding embodiments, the image forming apparatus 100 was described as an image forming apparatus that employs the intermediary transfer system. However, the present invention is equally applicable to an image forming apparatus which employs the direct transfer system. FIG. 12 shows an example of an image forming apparatus that employs the direct transfer system. In FIG. 12, the components which are the same as, or equivalent to, those of the image forming apparatus 100 shown in FIG. 1, in terms of function and structure, are given the same referential symbols as those given in FIG. 1. The image forming apparatus shown in FIG. 12 has a recording medium bearing member 92, for example, an endless belt (conveyer belt), in place of the intermediary transfer member 12 with which the image forming apparatus 100 shown in FIG. 1 is provided. It is also provided with a transferring means 5 (which is made up of transfer rollers or the like), which performs the same function as the primary transferring means of the image forming apparatus 100 shown in FIG. 1, and which is disposed in a manner to oppose the photosensitive drums 1*a*-1*t* of the image formation stations Pa—Pt, respectively, with the recording medium bearing member 92 disposed between the transferring means 5 and photosensitive drums 1*a*-1*t*. The toner images formed in the image formation stations Pa—Pd are sequentially transferred in layers onto the recording medium S on the recording medium bearing member 92.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 261413/2005 filed Sep. 8, 2005 which is hereby incorporated by reference.

What is claimed is:

1. A glossy image forming system comprising:

a color image forming portion including a photosensitive member and a developing device configured to develop an electrostatic image formed on said photosensitive member using color toner, wherein a color toner image on said photosensitive member formed by said developing device is transferred to a sheet;

a transparent image forming portion including a photosensitive member and a developing device configured to develop an electrostatic image formed on said photosensitive member using transparent toner, wherein a transparent toner image on said photosensitive member formed by said developing device is transferred to the sheet; and a controller configured to control said transparent image forming portion so that a maximum toner amount per unit area of the transparent toner image is larger than a maximum toner amount of the color toner image to form a glossy image on the sheet, wherein an electrostatic capacity per unit area of said photosensitive member of said transparent image forming portion is larger than an electrostatic capacity per unit area of said photosensitive member of said color image forming portion.

2. A system according to claim 1, wherein the electrostatic capacity per unit area of said photosensitive member of said transparent image forming portion is 2 to 3 times the electrostatic capacity per unit area of said photosensitive member of said color image forming portion.

3. A system according to claim 1, wherein a thickness of a photosensitive layer of said photosensitive member of said transparent image forming portion is smaller than a thickness of a photosensitive layer of said photosensitive member of said color image forming portion.

4. A system according to claim 3, wherein said photosensitive layer has a charge generation layer and a charge transfer layer.

5. A system according to claim 4, wherein said photosensitive layer has a surface protection layer.

6. A system according to claim 1, wherein a dielectric constant of a photosensitive layer of said photosensitive member of said transparent image forming portion is larger than a dielectric constant of a photosensitive layer of said photosensitive member of said color image forming portion.

7. A system according to claim 6, wherein said photosensitive layer has a charge generation layer and a charge transfer layer.

8. A system according to claim 7, wherein said photosensitive layer has a surface protection layer.

9. A system according to claim 1, wherein said developing devices are incorporated in a two component developer device using non-magnetic toner and a magnetic carrier.

10. A system according to claim 1, wherein said controller controls said transparent image forming portion so that the transparent toner image is formed at least on a region other than a region which the color toner image is formed in a image formation area of the sheet to form the glossy image on the sheet.

11. A system according to claim 10, wherein said controller controls said transparent image forming portion so that a surface of the sheet on which the color toner image and the transparent toner image are formed is smoothened.

12. A system according to claim 1, further comprising an intermediate transfer member confignred to transfer the color toner image and the transparent toner image from said photosensitive members, wherein the color toner image and the transparent toner image on said intermediate transfer member are transferred onto the sheet.

13. A system according to claim 1, wherein said color image forming portion includes a plurality of sets of said photosensitive member and such developing device for yellow toner, magenta toner, cyan toner and black toner, respectively, to form a full color toner image.

14. A system according to claim 1, wherein said color image forming portion includes a plurality of said developing devices for yellow toner, magenta toner, cyan toner and black toner, respectively, to form a full color toner image on said photosensitive member.

15. A system according to claim 1, wherein said photosensitive members are organic members.

16. A system according to claim 1, wherein said photosensitive members are inorganic photosensitive members.

* * * * *